US005172994A

United States Patent [19]

Brown

[11] Patent Number: 5,172,994

[45] Date of Patent: Dec. 22, 1992

[54] BALL POINT PEN WITH BENT TIP

[75] Inventor: Robert L. Brown, Boston, Mass.

[73] Assignee: The Gillette Company, Boston, Mass.

[21] Appl. No.: 622,857

[22] Filed: Dec. 6, 1990

Related U.S. Application Data

[62] Division of Ser. No. 501,077, Mar. 28, 1990, Pat. No. 5,012,663.

[51] Int. Cl.[5] ..... B43K 7/00; B43K 7/12

[52] U.S. Cl. ..... 401/209; 401/6; 401/216

[58] Field of Search ..... 401/209, 216, 6

[56] References Cited

U.S. PATENT DOCUMENTS 3,281,933 11/1966 Fehling et al. ..... 29/520
3,352,621 11/1967 Fehling et al. ..... 401/209 X
3,396,569 8/1968 Miller ..... 72/369
3,945,735 3/1976 Nakashiki et al. ..... 401/216

FOREIGN PATENT DOCUMENTS 496361 7/1954 Italy ..... 401/216
7767706 1/1980 U.S.S.R. .

*Primary Examiner*—Steven A. Bratlie
*Attorney, Agent, or Firm*—Owen J. Meegan; Aubrey C. Brine; Donal B. Tobin

[57] ABSTRACT

A ball point member for use in a ball point pen wherein a plurality of circumferential grooves are formed on one side only of the outer surface of the tubular body of the point member near the point ball. The point member is bent about a center of bending displaced from the axis of the tubular body in a direction whereby the grooved surface is on the compression side of the bend and the non-grooved surface is on the tension side of the bend while maintaining a compressive force throughout the tubular member.

4 Claims, 2 Drawing Sheets

BALL POINT PEN WITH BENT TIP

This is a divisional of copending application Ser. No. 07/501,077 filed on Mar. 28, 1990 now U.S. Pat. No. 5,012,663 issued May 7, 1991.

BACKGROUND OF THE INVENTION

The present invention relates to writing instruments of the ball point type and more particularly to a ball point member for use in a ball point pen and the method of manufacturing the same.

Various ball point pens are manufactured and marketed which have met with user acceptability and include both the type wherein a replaceable refill element is employed in a permanent outer casing, and those wherein the entire pen is disposable after the ink supply has been used. In either the case where a refill is employed, or the disposable type pen, the structure generally employs a tubular member formed by a thin wall having a spherical ball retained in one end and open at the opposite end for receiving the writing fluid and directing it to the surface of the ball.

In those ball point pens on the market today, the ball and socket extend from the point of the pen and are located on the longitudinal axis of the point or refill tube providing the greatest exposure of the ball surface in a plane at right angles to the axis of the pen. It would therefore follow that the best performance could be obtained from the instrument by the user orienting the pen casing at right angles to the writing surface during usage of the pen. However, this is generally not the orientation which is assumed by the user, as a more comfortable writing position is obtained with the pen oriented at an angle to the writing surface. It has been observed that some people write at such a low angle that the rim of the ball socket is caused to touch the paper while writing, which may cause skipping, or a rough feel. Thus, the optimum performance of the ball is not obtained, which may cause a skipping in the line of writing, or a change in line thickness or quality during the employment of the pen.

To overcome the above inadequacy, it has been suggested to bend the pen point such that the ball will be exposed at its maximum area while the user employs the pen at a comfortable angle relative to the writing surface. However, placing a bend in the relatively thin walled tube of the point or refill presents a problem in that the wall, which may be as thin as ten thousandths of an inch is easily stretched beyond the breaking point during the bending operation. Additionally, the stretching of the tube material may effect the wall at the socket where the ball is retained. A variance of one or two ten thousandths of an inch in accuracy at the ball and socket would in many instances cause the pen to fail to write, skip, be starved of ink or produce a blob of ink on the writing surface.

It is therefore an object of the present invention to provide a method of manufacturing a ball point pen member for use in a ball point pen wherein the tubular body member is bent without damage to the ball and socket of the pen.

A further object of the invention is to provide a method of manufacturing a ball point member wherein the pen point is bent without employment of expensive tooling and can be performed on existing pen making equipment.

Yet another object of the invention is to provide a method of manufacturing a ball point member for use in a ball point pen wherein the tubular body member is bent to an angle of at least 30° without destroying the integrity, or degrading the quality of the ball point member.

SUMMARY OF THE INVENTION

The aforementioned objects and other objectives which will become apparent as the description proceeds are accomplished by providing a method of manufacturing a ball point member for use in a ball point pen which includes the steps of providing a cylindrical pen point comprising a tubular body member formed by a thin wall and having a spherical ball retained in one end thereof and open at the opposite end for receiving writing fluid. At least one groove is formed circumferentially on the outer surface of the thin wall covering less than the entire circumference of the wall and leaving a non-grooved surface. The tubular body member is bent in a direction whereby the groove surface is on the compression side of the bend and the ungrooved surface is on the tension side of the bend.

In a more detailed sense, the method is performed maintaining an axial compressive force over the entire circumference of the tubular body member during the bending, which may be accomplished by bending the tubular body member about a center of bending displaced along a line extending from the longitudinal axis of the tubular body member through the non-grooved surface of the tubular body member.

The method may generally be accomplished by providing a pair of clamp means for retaining the tubular body member therebetween by gripping it, one on either side of the grooves. One of the clamp means is located on a rotatable member and the other is fixed relative to the rotatable member with the longitudinal axis of the tubular body member offset from the center of rotation of the rotatable member. The bending is accomplished by movement of the rotatable member.

The grooves are generally formed by rotation of the tubular body against a cutting tool on an axis offset from the longitudinal axis of the tubular body member to produce a maximum depth of groove on the compression side of the bend. The grooves may be two in number and are approximately one-half the wall thickness of the tubular body member at their greatest depth.

BRIEF DESCRIPTION OF THE DRAWING

The foregoing and other features of the invention will be particularly described in connection with the preferred embodiment, and with reference to the accompanying drawing, wherein.

DESCRIPTION OF THE PREFERRED EMBODIMENT

Figure 1:
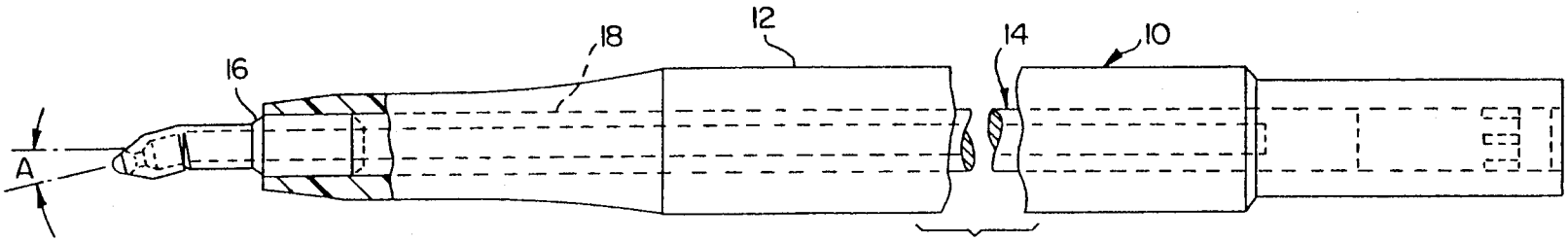
FIG. 1 is an elevational view showing a ball point pen constructed in accordance with the teachings of the present invention.

Referring now to the drawing and in particular to FIG. 1, there is shown a writing instrument 10 of the ball point type comprising a casing 12 and an ink carrying member 14 disposed within the casing. The ink carrying member 14 may be a refill in the example where the writing instrument 10 is of the refillable type, or may be discarded with the casing should the writing instrument be of the disposable type.

The ink containing member 14 generally comprises a metallic point 16 which is connected by press fit or other means to an ink containing tube 18 extending rearwardly into the writing instrument 10. The point 16 may be of stainless steel or other metallic construction and the tube 18 is of a metal or plastic material, as is well known in the art.

Thus far, the elements described are those typical of a writing instrument of the ball point type. However, it will be noted that in the writing instrument 10, the point 16 has been bent through an angle A to provide a ball point structure which facilitates usage employing the casing 12 at an angle to the writing surface. The angle A is generally 30° or greater to provide application of an optimum ball point surface to the writing surface during employment by the user.

Figure 4:
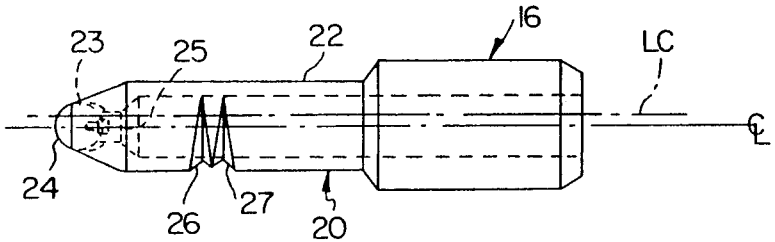
FIG. 4 is an elevational view showing the pen point of FIG. 2 during fabrication, employing the process of the present invention.
Figure 2:
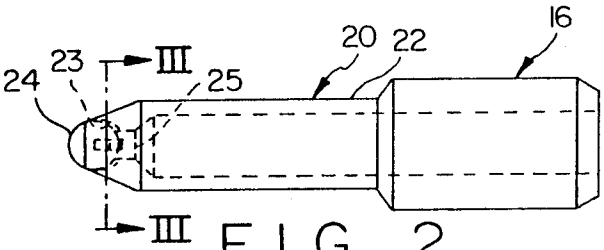
FIG. 2 is an elevational view showing a typical pen point to be employed in fabrication of the ball point pen of FIG. 1.
Figure 3:
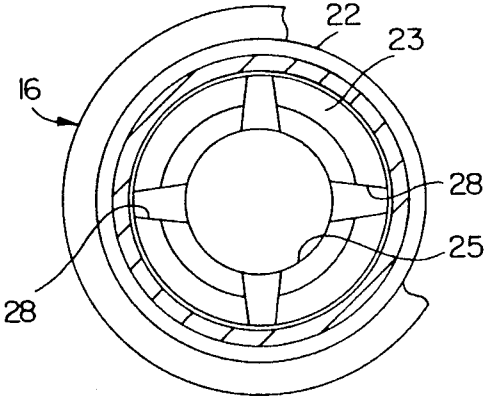
FIG. 3 is an elavational sectional view taken along the lines III—III of FIG. 2 showing details of the top of the pen point of FIG. 2 on an enlarged scale for clarity.

Referring now to FIGS. 2 through 4, point 16 is shown depicted in its condition prior to bending and is shown to comprise a tubular body member 20 formed by a thin wall 22 having a spherical ball 24 retained in one end, and open at the opposite end for receiving writing fluid. The spherical ball is retained within a socket 23 maintaining close tolerances in the area of one or two 10 thousandths of an inch, which may be accomplished by any well known method which is employed in the art of ball point pen construction. An orifice 25 is provided to conduct the ink to the surface of the ball through a plurality of ink channels 28 which are directed toward the open end of the socket 23 about the periphery of the ball 24. The thin wall 22 is shown to vary in thickness having its thinnest dimension generally in the area of ten thousandths to twenty thousandths of an inch in thickness.

As previously alluded to, in bending the thin wall 22 of the tube 18, a problem exists in that the stretching of the material at the tension side of the tube may create breakage or distortion of the ball socket 23 while compression of the thin wall could create a condition where the ink supply would be cut off due to collapsing of the wall inwardly.

Figure 5:
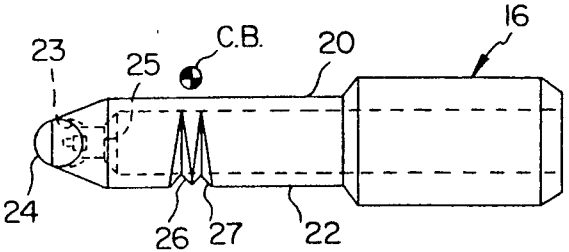
FIG. 5 is an elevational view similar to FIG. 3 showing further details of the fabrication process of the present invention.

Referring to FIGS. 4 and 5, it has been found that the providing of a groove, or in the embodiment shown a plurality of grooves 26 and 27 disposed circumferentially on the outer surface of the thin wall 22 such that the groove or grooves cover less than the entire circumference of the wall and leave a nongrooved surface on the tension side, is effective to alleviate the complication described above at the point of bending in the thin wall 22. The grooves 26 and 27 are approximately half the depth of the thickness of the thin wall 22 at their deepest point in the wall and may be formed at a 90° angle, as shown, by employment of a cutting tool designed for that purpose. As best shown in FIG. 4, the grooves 26 and 27 may be formed by rotation of the body member 20 against a suitable cutting tool on an axis LC offset from the centerline of the body member 20. By so forming the grooves 26 and 27, the depth of groove diminishes from a maximum at the point desirable for maximum compression during bending to a minimum depth adjacent the tension area of the body member 20.

While the tube 18 may be bent employing the grooves 26 and 27 to alleviate the above described problems, it has been found that by maintaining an axial compressive force over the entire circumference of the body member 20, a more desirable bend is created and the integrity of the thin wall 22 is maintained to a greater extent, but more importantly the ball socket 23 is not distorted.

Referring to FIG. 5, in bending the body member 20, it is possible to maintain a compressive force throughout the circumference of the thin wall 22 by bending about a center of bending CB which is displaced from the longitudinal axis of the tubular body 20. The location of the center of bending CB may be calculated to produce a moment arm sufficient to maintain a compressive force in the thin wall 22 at its nearest point to the center of bending CB when an axial force is applied to the body member 20 of sufficient magnitude to create the desired bend in the point 16. Thus, bending is accomplished without stretching the thin wall 22 which could have a resultant adverse effect of the socket 23.

Figure 6:
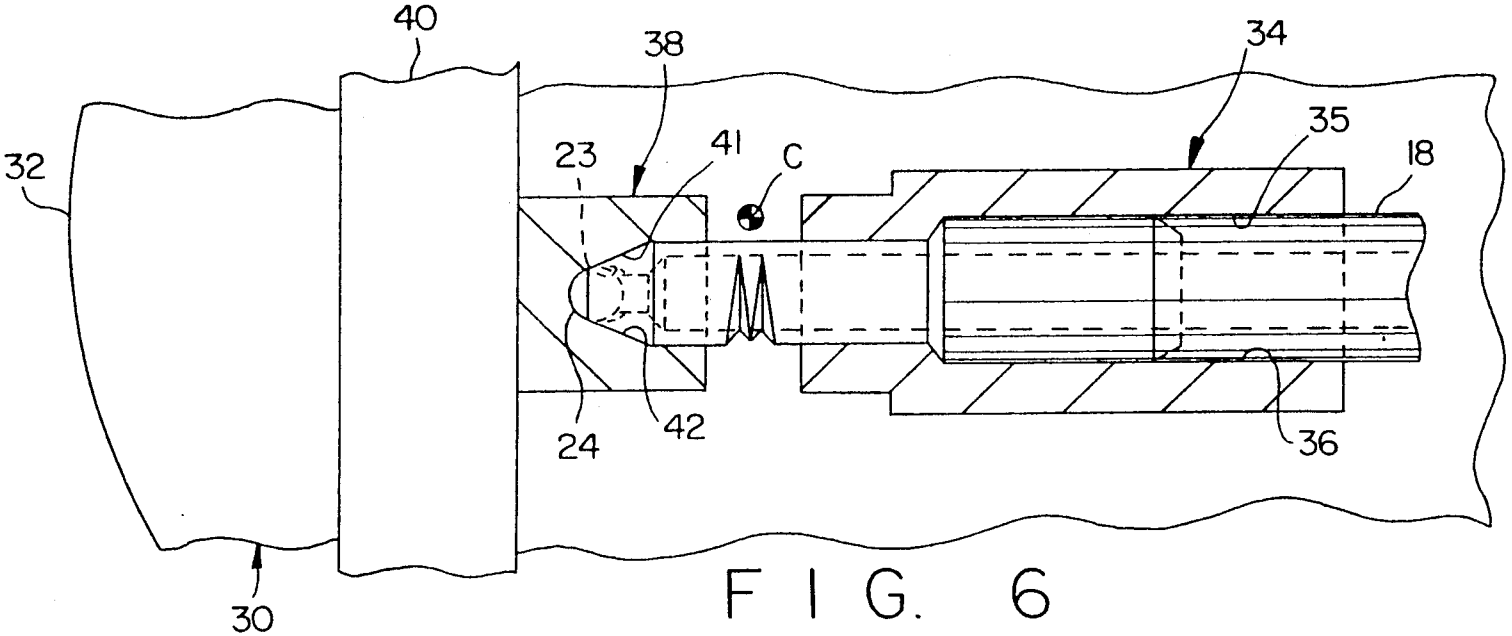
FIG. 6 is a schematic top plan view showing a typical device constructed to perform the process of the present invention.

Referring now to FIG. 6, there is shown in schematic a device 30 which is suitable for conducting the bending method described above. The device 30 comprises a rotatable table 32 having a clamp 34 mounted on the surface thereof providing internal clamping surfaces 35 and 36. A second clamping means in the form of a clamp 38 is mounted on a fixed surface 40 and has internal clamping surfaces 41 and 42 in alignment with the surfaces 35 and 36. The clamps 34 and 38 may be of any type well known in the art which are capable of maintaining the body member 20 with the ball end firmly held between the surfaces 41 and 42 and the open end held between the surfaces 35 and 36, maintaining that portion of the body member having the grooves 26 and 27 formed thereon free to reform during the bending operation. The tube 18 forming an ink reservoir 50 is usually assembled to the body member 20, prior to bending, as will be observed in FIG. 6.

As will further be noted in FIG. 6, the clamps 34 and 38 are mounted in alignment such that the longitudinal axis of the body member 20 is at a right angle to the centerline C of rotation. The centerline C is normal to the surface of the table and is displaced to the side opposite the grooves. With the employment of the device 30, the centerline C of the table further becomes the center of bending CB of the body member 20 and therefore, the longitudinal axis of the body member is spaced from the centerline C the distance calculated to perform the bending operation while maintaining compression about the circumference of the thin wall 22, as explained above.

It should be understood that while in the embodiment shown, the clamp 34 is mounted on the rotatable table 32 and the clamp 38 is fixed, the clamp 38 could be mounted on the rotatable table 32 and the clamp 34 fixed to produce the same bending result by rotation of the table 32 in the opposite direction.

Figure 7:
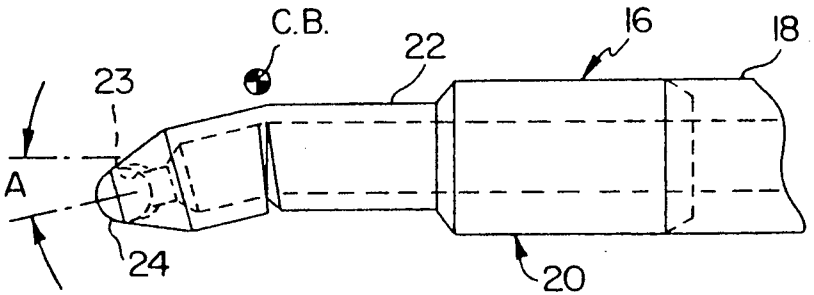
FIG. 7 is an elevational view similar to FIGS. 2 through 4 showing a pen point fabricated in accordance with the process of the present invention.

With the body member 20 mounted in the clamps 34 and 38, the table 32 is rotated through an angle until the bend is accomplished, providing a body member 20 as shown in FIG. 7.

As shown in FIG. 7, the bend takes place about the center of bending CB causing the compression of the grooves 26 and 27 with little or no distortion of the inner wall of the thin wall 22 on the compression side, and due to the compressive force retained on the tension side of the thin wall 22, there is a minimum amount of stretching in the wall to thereby maintain the integrity of the socket 23. By employment of the grooves 26 and 27 in combination with the bending about a center of bending displaced from the longitudinal axis of the body member 20, it has been found that the ball 24 retains its dimensional integrity with regard to the capsulating surface of the ball socket 23 through a bend angle A of 30°, or greater.

While it is apparent that changes and modifications may be made within the spirit and scope of the present application, it is my intention, however, only to be limited by the scope of the appended claims.

As my invention, I claim:

1. A ball point member for use in a ball point pen comprising:

a cylindrical point member comprising a tubular body member formed by a thin wall structure having a spherical ball retained in one end thereof and open at the opposite end for receiving writing fluid, said thin wall structure having at least one groove circumferentially formed from the outer surface thereof and terminating within said thin wall structure, said groove covering less than the entire outer circumference of the thin wall structure and leaving a non-grooved surface wherein said body member is bent in a direction whereby the grooved surface is on the compression side of the bend and the ungrooved surface is on the tension side of the bend.

2. The ball point pen member of claim 1 wherein the grooves are two in number.

3. The ball point pen member of claim 1 wherein the tubular body is bent at an angle of at least 30°.

4. The ball point pen member of claim 1 wherein the grooves are in the range of one half the thickness of said thin wall structure at the deepest point.

* * * * *